US005422619A

United States Patent [19]

Yamaguchi et al.

[11] Patent Number: 5,422,619

[45] Date of Patent: Jun. 6, 1995

[54] COMMON MODE CHOKE COIL

[75] Inventors: Kouichi Yamaguchi; Toshinori Amano, both of Nagaokakyo, Japan

[73] Assignee: Murata Manufacturing Co., Ltd., Nagaokakyo, Japan

[21] Appl. No.: 295,476

[22] Filed: Aug. 25, 1994

Related U.S. Application Data

[63] Continuation of Ser. No. 932,249, Aug. 19, 1992, abandoned.

[30] Foreign Application Priority Data

Aug. 20, 1991 [JP] Japan ..... 3-65720 U

[51] Int. Cl.[6] ..... H01F 27/28

[52] U.S. Cl. ..... 336/184; 336/181; 336/182

[58] Field of Search ..... 336/180, 181, 182, 184

[56] References Cited

U.S. PATENT DOCUMENTS

| | | | |
|---|---|---|---|
| 979,986 | 12/1910 | Morgan | 336/184 X |
| 1,575,552 | 3/1926 | Dow | 336/182 X |
| 2,523,778 | 9/1950 | Randall | 336/184 X |
| 3,328,738 | 6/1967 | Broverman et al. | 336/184 X |
| 4,763,093 | 8/1988 | Cirkel et al. | 336/181 X |

FOREIGN PATENT DOCUMENTS

| | | | |
|---|---|---|---|
| 2159111 | 9/1972 | Germany | 336/213 |
| 421283 | 7/1962 | Switzerland | 336/181 |

*Primary Examiner*—Leo P. Picard
*Assistant Examiner*—L. Thomas
*Attorney, Agent, or Firm*—Burns, Doane, Swecker & Mathis

[57] ABSTRACT

A common mode choke coil having a couple of cores shaped like U and four coils wound around legs of the cores. The cores having coils around their legs are butt-jointed at the end, and coils wound around each couple of butted legs cause magnetic fluxes in mutually opposite directions.

4 Claims, 3 Drawing Sheets

COMMON MODE CHOKE COIL

This application is a continuation of application Ser. No. 07/932,249, filed Aug. 19, 1992, now abandoned.

BACKGROUND OF THE INVENTION

1. Field of the Invention

The present invention relates to a common mode choke coil for eliminating common mode noise.

2. Description of Related Art

FIG. 6 shows an equivalent circuit of a conventional common mode choke coil, and according to the figure, coils L11 and L12 are arranged facing to each other such that magnetic fluxes in mutually opposite directions will be generated around the coils L11 and L12.

FIG. 4 shows a common mode choke coil 30 which has a structure which can realize the equivalent circuit shown in FIG. 6. A couple of cores 31 and 32 shaped like E are butt-jointed. The center legs 31*a* and 32*a* of the cores 31 and 32 are wound with coils L11 and L12 respectively such that magnetic fluxes in mutually opposite directions will be generated around the coils L11 and L12.

The coils L11 and L12 are disposed on the same axis, and thereby, the common mode choke coil 30 obtains an advantage that the leakage of magnetic flux is small.

FIG. 5 shows a common mode choke coil 40 which has another structure which can realize the equivalent circuit shown in FIG. 6. A couple of cores 41 and 42 shaped like U are butt-jointed. Mutually butted legs 41*a* and 42*a* of the cores 41 and 42 are wound with a coil L11, and the other mutually butted legs 41*b* and 42*b* of the cores 41 and 42 are wound with a coil L12. The coils L11 and L12 are wound such that magnetic fluxes in mutually opposite directions will be generated around the coils L11 and L12.

The legs 41*a*, 42*a*, 41*b* and 42*b* of the cores 41 and 42 are extended by the butt joint, and the coils L11 and L12 are disposed on the extended legs. Accordingly, the coils L11 and L12 are long enough such that the common mode choke coil 40 obtains an excellent frequency characteristic. Higher the frequency characteristic is, more excellent the performance of the common mode choke coil is.

In FIGS. 4 and 5, arrows indicate directions of magnetic fluxes generated around the coils.

The above-described conventional common mode choke coils have disadvantages as follows.

The common mode choke coil 30 shown in FIG. 4 uses the E-shaped cores 31 and 32, and the coils L11 and L12 wound therearound are not sufficiently long. Accordingly, the common mode choke coil 30 has a poor frequency characteristic.

Regarding the common mode choke coil 40 shown in FIG. 5, magnetic fluxes leak from the coils L11 and L12 in the same direction, which brings a synergetic effect. Consequently, the leakage of magnetic flux becomes large.

SUMMARY OF THE INVENTION

An object of the present invention is to provide a common mode choke coil which has an excellent frequency characteristic and has only a small leak of magnetic flux.

In order to attain the object, a common mode choke coil according to the present invention comprises: a couple of U-shaped cores, each core having two legs; and coils wound around the legs of the cores. The cores are butt-jointed at ends of the legs, and in this state, two coils wound around each couple of butted legs cause magnetic fluxes in mutually opposite directions.

In the structure, each couple of butted legs is wound with two coils which cause magnetic fluxes in mutually opposite directions, and thereby, the magnetic fluxes are offset by each other. Consequently, the leakage of magnetic flux from the common mode choke coil is small.

In addition, the two cores as a whole have two couples of coils such that each couple of coils causes magnetic fluxes in the same direction, and the magnetic fluxes in the same direction are added to each other. Consequently, the common mode choke coil can obtain an excellent frequency characteristic.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Some exemplary common mode choke coils according to the present invention are hereinafter described with reference to the accompanying drawings.

Figure 1:
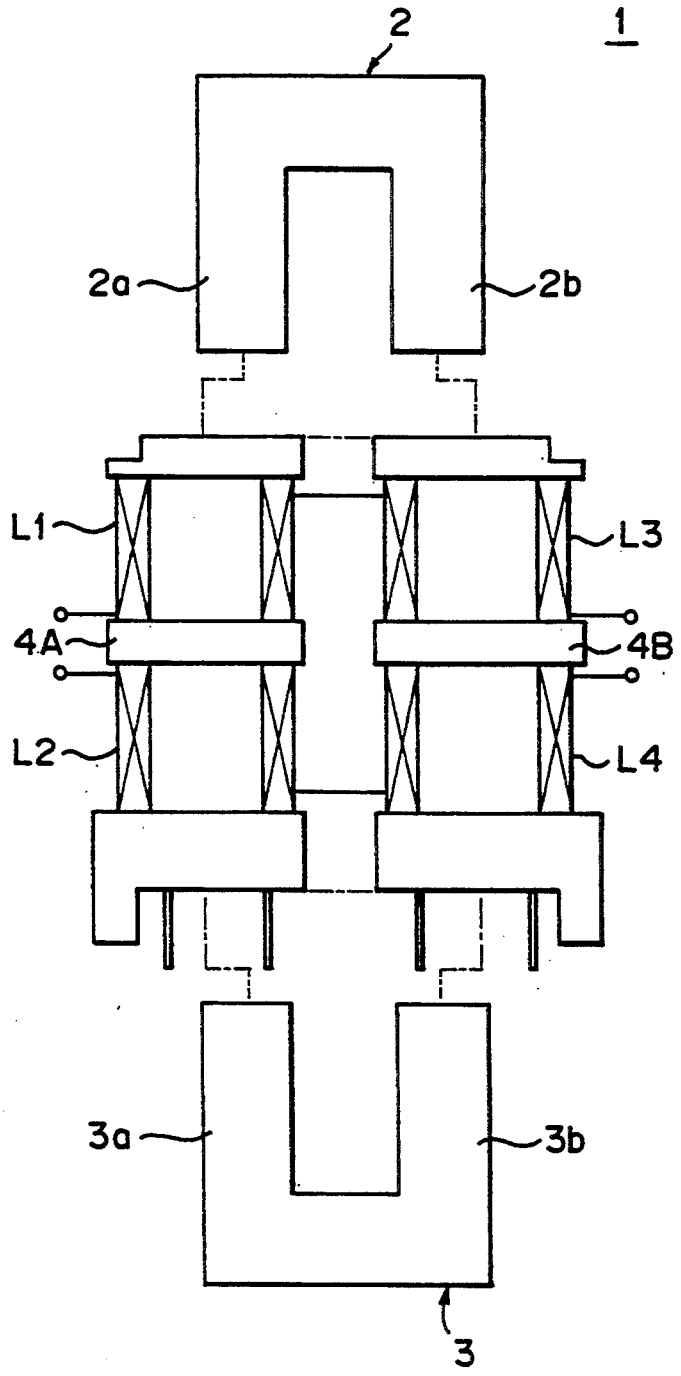
FIG. 1 is an exploded view of a common mode choke coil which is a first embodiment of the present invention.
Figure 2:
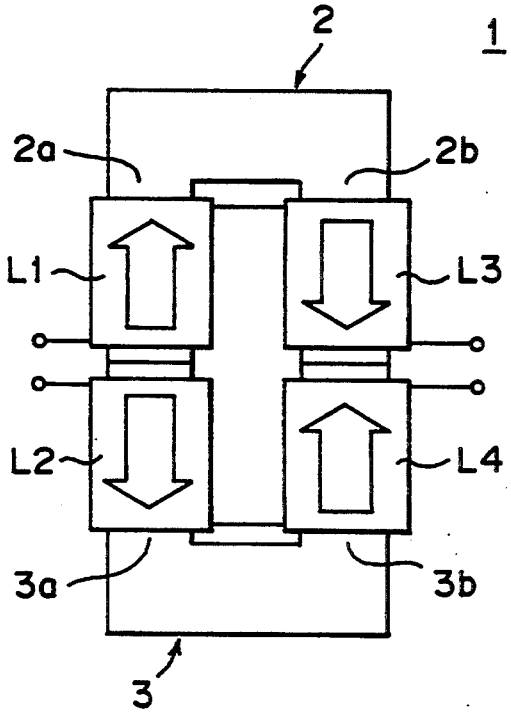
FIG. 2 is a plan view of the common mode choke coil showing directions of magnetic fluxes.
Figure 3:
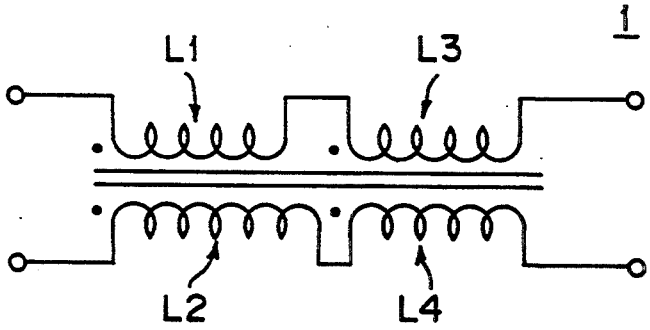
FIG. 3 is a diagram showing the equivalent circuit of the common mode choke coil.
Figure 4:
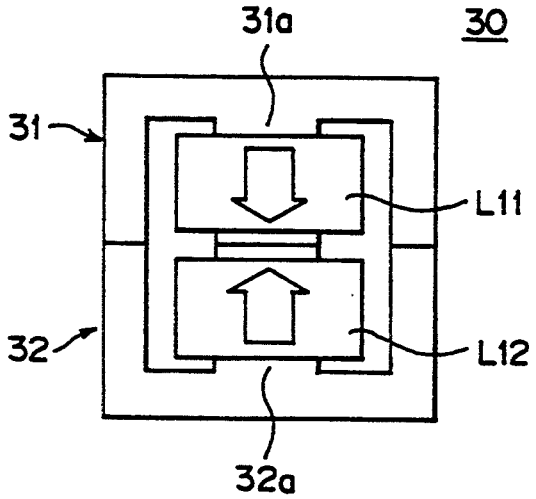
FIG. 4 PRIOR ART
FIG. 4 is a plan view of a prior art common mode choke coil.
Figure 5:
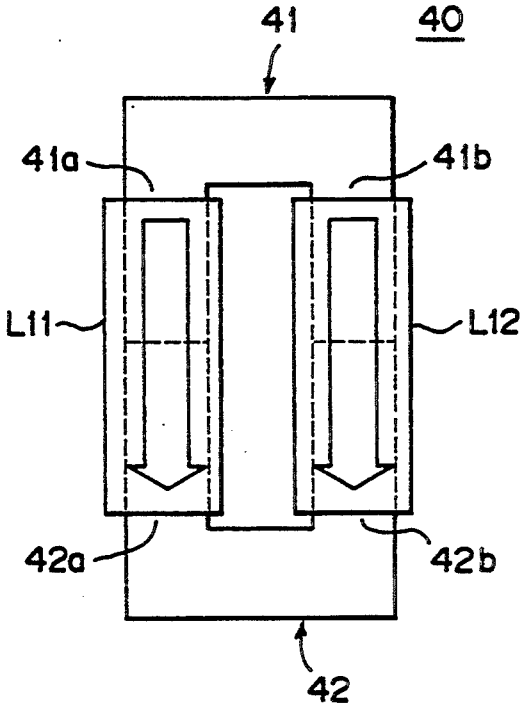
FIG. 5 PRIOR ART
FIG. 5 is a plan view of another prior art common mode choke coil.
Figure 6:
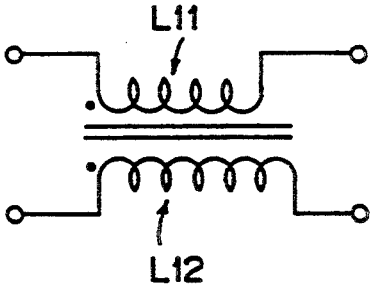
FIG. 6 PRIOR ART
FIG. 6 is a diagram showing the equivalent circuit of the prior art common mode choke coils.

FIG. 1 shows the structure of a common mode choke coil 1 which is a first embodiment of the present invention. FIG. 2 shows directions of magnetic fluxes of the common mode choke coil 1. FIG. 3 shows the equivalent circuit of the common mode choke coil 1. In the figures, arrows indicate directions of magnetic fluxes generated around coils.

The common mode choke coil 1 has a first core 2 and a second core 3 which are shaped like U, and bobbins 4A and 4B. The core 2 has legs 2*a* and 2*b*, and likewise, the core 3 has legs 3*a* and 3*b*. The cores 2 and 3 are Jointed such that the leg 2*a* and the leg 3*a*, and the leg 2*b* and the leg 3*b* are butted respectively at the end. The bobbins 4A and 4B are loosely fitted around the butted legs 2*a* and 3*a*, and 2*b* and 3*b* respectively.

The bobbins 4A and 4B are wound with four coils altogether. A first coil L1 and a second coil L2 are wound around the bobbin 4A. A third coil L3 and a fourth coil L4 are wound around the bobbin 4B. In other words, the first coil L1 and the second coil L2 are wound around the same axis, and the third coil L3 and the fourth coil L4 are wound around the same axis.

The first coil L1 is connected to the third coil L3, and the second coil L2 is connected to the fourth coil L4. The coils L1 through L4 are coiled such that magnetic fluxes generated around the first coil L1 and the second coil L2 are in mutually opposite directions, that magnetic fluxes generated around the third coil L3 and the fourth coil L4 are in mutually opposite directions, that magnetic fluxes generated around the first coil L1 and the third coil L3 are in the same direction and that magnetic fluxes generated around the second coil L2 and the fourth coil L4 are in the same direction.

By setting the coils L1 through L4 as above, each couple of the butted legs 2*a* and 3*a*, and 2*b* and 3*b* has two coils which cause magnetic fluxes in mutually opposite directions. Thereby, the magnetic fluxes generated therearound are offset by each other, and consequently, the leakage of magnetic flux is small.

In addition, each of the cores 2 and 3 has two coils which cause magnetic fluxes in the same direction. Thereby, the magnetic fluxes generated therearound are added to each other, and this is that which can be achieved by providing long coils. Consequently, the common mode choke coil 1 obtains an excellent frequency characteristic.

Those skilled in the art will appreciate that alternate embodiments can be implemented. For example, an alternate embodiment can be implemented wherein the alternate embodiment differs from the first embodiment in directions of magnetic fluxes. In the alternate embodiment, the four coils L1 through L4 are coiled such that magnetic fluxes generated around the first coil L1 and the second coil L2 are in mutually opposite directions, that magnetic fluxes generated around the third coil L3 and the fourth coil L4 are in mutually opposite directions, that magnetic fluxes generated around the first coil L1 and the fourth coil L4 are in the same direction and that magnetic fluxes generated around the second coil L2 and the third coil L3 are in the same direction.

By setting the coils L1 through L4, each couple of the butted legs 2*a* and 3*a*, and 2*b* and 3*b* has two coils which cause magnetic fluxes in mutually opposite directions. Thereby, magnetic fluxes generated therearound are offset by each other, and consequently, the leakage of magnetic flux is small.

In addition, the cores 2 and 3 as a whole can have two couples of coils (coils L1 and L4, and coils L2 and L3) such that each couple of coils causes magnetic fluxes in the same direction, which brings a synergetic effect. Consequently, the common mode choke coil 10 obtains an excellent frequency characteristic.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A common mode choke coil comprising:

first and second U-shaped cores each of which has two legs, the first and second cores being butt-jointed at ends to form a closed magnetic circuit;

a first input terminal and a first output terminal;

a second input terminal and a second output terminal;

a coil structure for generating offsetting magnetic fluxes around said closed magnetic circuit, said coil structure including:

at least two first coils which are wound in a first direction around the closed magnetic circuit and electrically connected in series between the first input terminal and the first output terminal for generating a magnetic flux in a first direction along the closed magnetic circuit; and at least two second coils which are wound in a second direction, opposite said first direction, around the closed magnetic circuit and electrically connected in series between the second input terminal and the second output terminal for generating an offsetting magnetic flux in a second direction opposite to the first direction of the magnetic flux generated by the first coils along the closed magnetic circuit.

2. A common mode choke coil as recited in claim 1, wherein the first coils are wound around the legs of one of said U-shaped cores to generate magnetic flux in said first direction, and the second coils are wound around the legs of the other of said U-shaped cores to generate magnetic flux in said second direction opposite to the first direction of the magnetic flux generated by the first coils.

3. A common mode choke coil comprising:

first and second U-shaped cores each of which has two legs, the two legs of the first U-shaped core being jointed to the two legs of the second U-shaped core to form a closed magnetic circuit having at least first and second sides;

a first input terminal and a first output terminal;

a second input terminal and a second output terminal;

a coil structure for generating offsetting magnetic fluxes around said closed magnetic circuit, said coil structure including:

at least two first coils which are wound in a first direction around the closed magnetic circuit and electrically connected in series between the first input terminal and the first output terminal for generating a magnetic flux in a first direction along the closed magnetic circuit; and at least two second coils which are wound in a second direction, opposite said first direction, around the closed magnetic circuit and electrically connected in series between the second input terminal and the second output terminal for generating an offsetting magnetic flux in a second direction opposite to the first direction along the closed magnetic circuit, one of said two first coils being wound around one side of said closed magnetic circuit and the other of said two first coils being wound around the other side of said closed magnetic circuit.

4. A common mode choke coil as recited in claim 3, wherein the first coils are wound around the legs of one of said U-shaped cores to generate magnetic flux in said first direction, and the second coils are wound around the legs of the other of said U-shaped cores to generate magnetic flux in said second direction opposite to the first direction of the magnetic flux generated by the first coils.

* * * * *